United States Patent [19]

Schemmann et al.

[11] 4,008,985

[45] Feb. 22, 1977

[54] PUMPING DEVICE FOR FLUIDS

[75] Inventors: Hugo Schemmann, Schaesberg, Netherlands; Leo Bertram, Stolberg, Germany

[73] Assignee: U.S. Philips Corporation, New York, N.Y.

[22] Filed: Jan. 24, 1975

[21] Appl. No.: 543,767

[30] Foreign Application Priority Data

Feb. 14, 1974 Germany ..... 2407109

[52] U.S. Cl. ..... 417/423 R; 415/141; 310/162

[51] Int. Cl.[2] ..... F04B 17/00

[58] Field of Search ..... 415/141; 417/423 R; 310/156, 162, 164, 74; 416/240

[56] References Cited

UNITED STATES PATENTS

| | | | |
|---|---|---|---|
| 1,116,851 | 11/1914 | Schneible | 415/141 |
| 1,402,719 | 1/1922 | Bartlett et al. | 415/141 |
| 2,404,678 | 7/1946 | Wuensch | 415/141 |
| 2,669,188 | 2/1954 | McIntyre | 415/141 |
| 2,671,408 | 3/1954 | Kreitchman | 415/141 |
| 2,688,930 | 9/1954 | DeMoss | 415/141 |
| 2,787,962 | 4/1957 | Smith | 415/141 |
| 3,502,030 | 3/1970 | Bukewihge et al. | 417/423 R |
| 3,510,229 | 5/1970 | Smith | 415/141 |
| 3,675,059 | 7/1972 | Thees | 310/162 |
| 3,819,966 | 6/1974 | Noguchi | 310/74 |

FOREIGN PATENTS OR APPLICATIONS

| | | | |
|---|---|---|---|
| 1,113,729 | 12/1955 | France | 415/146 |

*Primary Examiner*—C. J. Husar
*Attorney, Agent, or Firm*—Frank R. Trifari; David R. Treacy

[57] ABSTRACT

A pumping device for fluids, in particular for low-viscosity liquids such as washing suds or rinsing water, having a pump impeller whose flexible vanes rotate in an annular chamber, and a synchronous drive motor, the elasticity of the pump vanes being sufficient that the required accelerating moments during starting do not exceed the maximum torque produced by the motor, and the drive motor undergoes torsional vibrations during the starting phase.

4 Claims, 2 Drawing Figures

PUMPING DEVICE FOR FLUIDS

BACKGROUND OF THE INVENTION

1. Field of the Invention

The invention relates to a pumping device for fluids, especially low-viscosity fluids such as washing suds or rinsing water. Such a device usually comprises a pump impeller, whose flexible vanes rotate in an annular pump chamber, and an electrical drive motor.

For fluid pumping a multitude of pumping devices are known. A pump impeller provided with vanes is rotated in a pump chamber by a drive shaft. Between the vanes and the pump chamber wall pumping compartments are formed in which the fluid which has entered the individual pumping compartments is accelerated and forced into a discharge connection.

2. Description of the Prior Art

Known pumps are usually driven by means of asynchronous motors which are commercially available at a low price, but which have a very poor efficiency. The poor efficiency makes it necessary to provide adequate cooling for the machine. Thus, pumping devices for fluids are generally substantially expensive and bulky. In the case of tight mounting conditions especially the large volumes of the units present problems.

It is known from the book "Centrifugal Pumps" by I. J. Karassik, pages 275 to 314) to drive pumps with single-phase synchronous motors. However, for dependable operation starting aids such as auxiliary windings and rotor cages are employed. Such starting aids are expensive.

It is also known (U.S. Pat. No. 1,402,719) to make the pump vanes flexible as so as to avoid jamming due to objects catching between the vanes and the pump chamber wall.

SUMMARY OF THE INVENTION

It is desirable to employ a pump drive motor whose rated torque should substantially correspond to the loading torque. Only such a motor is utilized in accordance with its rating and can be accordingly small. Further for reasons of economy a self-starting single-phase synchronous motor without starting aids, hereinafter referred to as "pure single-phase synchronous motor", might be considered for driving pumps. However, every self-starting pure single-phase synchronous motor, because it does not have additional starting means, must attain the rated speed within a quarter revolution after starting. When during this time it must drive a load with a high moment of inertia, the required accelerating moments will exceed the stalled torque produced by the motor, and therefore the motor will not start.

It is an object of the invention to provide a pumping device for fluids which employs a pure single-phase synchronous motor but which can still have small dimensions and is thus of an economic design.

To achieve this object, according to the invention the elasticity of the pump vanes is selected to be sufficiently great that the required accelerating moments of the pump assembly during starting do not exceed the maximum torque that can be produced by the motor, and that the drive motor undergoes torsional vibrations during the starting phase.

The elasticity of the pump vanes allows a greater total inertia to be accelerated at the same stalling torque, because flexure of the vanes allows the shaft to accelerate faster than the vane tips. Therefore the motor need not be over-dimensioned for reasons of acceleration.

When a motor is used which, during starting, undergoes torsional vibrations, the pump impeller will also briefly undergo torsional vibrations related to the motor vibrations, which will eliminate jamming, should this have occurred. When pumping off washing suds or rinsing water in washing machines hard objects such as buttons, clothes pegs etc., and fluff frequently get into the pump. When no fine-mesh filters are included which retain said hard objects and fluff, this may lead to blocking and damaging of the pump impeller and the motor. The torsional vibrations of the pump impeller and the flexibility of the pump vanes render the use of fine-mesh filters superfluous, and produce reliable operation.

In the preferred embodiment of the invention a pure single phase synchronous motor is used as the drive motor. Such a single-phase synchronous motor preferably comprises a permanent-magnet rotor. Such a single-phase synchronous motor, known for example from U.S. Pat. No. 3,675,059, performs the torsional vibrations required during starting. In addition, the direction of rotation of said single-phase synchronous motor is not pre-determined. Thus, it starts either in one direction or in the other direction. This yields the additional advantage that threads which may be wound around the pump shaft are again unwound by the different starting directions.

For a drive motor with a power consumption of approximately 25 W the pump impeller diameter is preferably selected so that the starting time constant does not exceed 5 milliseconds. This ensures a rapid acceleration of the single-phase synchronous motor which drives the pump impeller.

BRIEF DESCRIPTION OF THE DRAWINGS

The invention will now be described in more detail with reference to the embodiment shown in the drawing. In the drawing.

Figure 1:
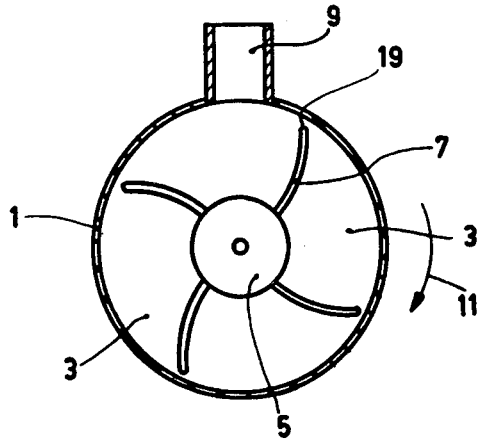
FIG. 1 is a radial section of the pump device according to the invention.

The pump device consists of a pump housing 1, by which an annular compartment 2 is bounded in which an impeller 5 rotates. The annular compartment 2 is divided into several pump chambers 3 with the aid of the elastic vanes 7 of the pump impeller. At the top of the housing 1 a discharge connection 9 extends radially from the compartment 2. The impeller 5 in the embodiment of FIG. 1 is shown as it would be when rotating in the direction of arrow 11.

Figure 2:
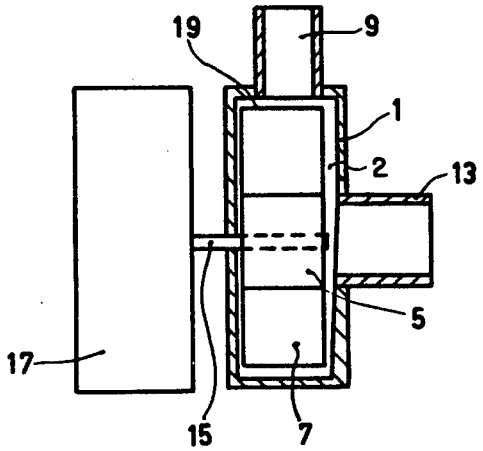
FIG. 2 is an axial section of the pump device of FIG. 1.

As shown in FIG. 2 a pump inlet connection 13 terminates axially in the housing 1.

The impeller 5 is driven by a pure single-phase synchronous motor 17, that does not have direction determining starting aids, via a shaft 15.

The vanes 7 of the pump impeller are elastic to such a degree that their free ends 19 during clockwise and anti-clockwise rotation of the shaft 15 and the impeller 5 always bend back against the direction of rotation. At increasing pressure in the discharge connection 9 and thus at increasing load of the impeller 5 the vanes will bend back further.

Because of the elasticity of its vanes 7 the pump device can be driven in either direction, the pump capacity being the same in either case, as is clearly shown in the Figure.

The pump impeller vanes are made of silicon rubber. Their elasticity is chosen according to the size of the pump and the single-phase synchronous motor 17 by which it is driven.

What is claimed is:

1. A pumping device for fluids, in particular for low viscosity liquids, comprising an annular pump chamber, a pump impeller having flexible vanes mounted for rotation in said chamber, and a drive motor connected to said pump impeller, wherein the motor is a pure single-phase synchronous motor, and the impeller vanes have sufficient elasticity to bend backward during acceleration such that the motor can accelerate to full speed within a quarter revolution after starting upon application of electrical power.

2. A device as claimed in claim 1, wherein said motor comprises a permanent magnetic rotor.

3. A device as claimed in claim 1, wherein said motor is a type which undergoes torsional vibration during starting.

4. A device as claimed in claim 1, wherein said motor is bi-directional.

* * * * *